US008532506B2

(12) United States Patent
Jones et al.

(10) Patent No.: US 8,532,506 B2
(45) Date of Patent: Sep. 10, 2013

(54) MULTIPLE MARKET CONSUMABLE ID DIFFERENTIATION AND VALIDATION SYSTEM

(75) Inventors: Brent Rodney Jones, Sherwood, OR (US); Brian Patterson, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 390 days.

(21) Appl. No.: 12/955,321

(22) Filed: Nov. 29, 2010

(65) Prior Publication Data

US 2012/0134687 A1 May 31, 2012

(51) Int. Cl.
*G03G 15/00* (2006.01)

(52) U.S. Cl.
USPC ..... 399/12

(58) Field of Classification Search
USPC ..... 399/12, 9
See application file for complete search history.

(56) References Cited

U.S. PATENT DOCUMENTS

| | | | | |
|---|---|---|---|---|
| 6,850,715 | B2 * | 2/2005 | Maehara | 399/27 |
| 6,940,613 | B1 | 9/2005 | Beard et al. | |
| 7,321,737 | B2 | 1/2008 | Swann et al. | |
| 7,551,859 | B2 | 6/2009 | Miller et al. | |
| 7,664,257 | B2 | 2/2010 | Hohberger et al. | |
| 7,665,817 | B2 | 2/2010 | Folkins | |
| 8,311,419 | B2 * | 11/2012 | Jones et al. | 399/12 |
| 2004/0223011 | A1 | 11/2004 | Adkins et al. | |
| 2006/0051106 | A1 * | 3/2006 | Takahashi et al. | 399/12 |
| 2007/0127936 | A1 | 6/2007 | Miller | |
| 2007/0223942 | A1 * | 9/2007 | Miller | 399/12 |
| 2009/0222886 | A1 | 9/2009 | Lee et al. | |
| 2009/0241184 | A1 | 9/2009 | Doering | |
| 2010/0039485 | A1 | 2/2010 | Rodriguez et al. | |

OTHER PUBLICATIONS

Search Report for Related Application No. GB1120112.6, dated Mar. 21, 2012.

* cited by examiner

*Primary Examiner* — Walter L Lindsay, Jr.
*Assistant Examiner* — Rodney Bonnette
(74) *Attorney, Agent, or Firm* — Ronald E. Prass, Jr.; Prass LLP

(57) ABSTRACT

According to aspects of the embodiments, there is provided systems, computer readable media, and methods to authenticate a customer replaceable unit (CRU) in a printer system by comparing a validation code in the CRU with a printer generated validation code. The Validation Code is a string of numbers and/or characters that can be referred to as a value. The validation code will be comprised of a value string including programmed characters representing a combination of all or portions of a market program designator or code, consumable identification (ID) information and a randomly generated value, which may be hidden from view. The code is independently established by the printing system or device using the same algorithm and information and validates the resulting Code when they match. The printing system or device must confirm the Validation Code and ID applicability of the consumable to deem it appropriate for use.

21 Claims, 10 Drawing Sheets

MULTIPLE MARKET CONSUMABLE ID DIFFERENTIATION AND VALIDATION SYSTEM

RELATED APPLICATION

This application is related to the following co-pending application, which is hereby incorporated by reference in its entirety: "CONSUMABLE ID DIFFERENTIATION AND VALIDATION SYSTEM WITH ON-BOARD PROCESSOR", U.S. patent application Ser. No. 12/955,266 to Brian Patterson et al., filed on Nov. 29, 2010, and issued as U.S. Pat. No. 8,311,419, issued on Nov. 13, 2012.

BACKGROUND

This disclosure relates in general to controlling replaceable modules in a printing system, such as a digital printing apparatus. More specifically, the invention relates to a computerized method and system for encoding imaging device consumables so that products with appropriate preprogramming are able to accommodate and recognize authorized consumables likely to be encountered over their lifetime.

Many machines have replaceable sub-assemblies. These subassemblies may be arranged as unit called a cartridge, and if intended for replacement by the customer or machine owner, may be referred to as a customer replaceable unit (CRU). Examples of a CRU may include printer cartridge, toner cartridge, transfer assembly unit, photo conductive imaging unit, transfer roller, fuser or drum oil unit, and the like. It may be desirable for a CRU design to vary over the course of time due to manufacturing changes or to solve post-launch problems with either the machine, the CRU, or a CRU and machine interaction. It is known to provide the CRU with a monitoring device commonly referred to as a CRUM (Customer Replaceable Unit Monitor). A CRUM is typically a memory device, such as a ROM, EEPROM, SRAM, or other suitable non-volatile memory device, provided in or on the cartridge. Information identifying the CRU is written on the EEPROM during manufacture of the CRUM. For example, information identifying a CRU as a developer cartridge and identifying the type of carrier, developer, and transfer mechanism contained in the developer cartridge may be written in the memory contained in the CRUM. When a CRU containing such a CRUM is installed in a machine, the machine's control unit reads the identifying information stored in the CRUM.

It is also important to ensure that CRUs (Customer Replaceable Units) are authentic and meet the original equipment manufacturer's (OEM) operational specifications. Imaging devices such as printers may be programmed to function differently in different markets even though the hardware is identical. Actions such as reconfiguring or copying electronic chip based identification creates significant problems affecting not only the profits of the manufacturer but also legitimate resellers as well as entailing product functionality risks and reduced image quality for the customer. Poor quality counterfeiting may also present customers with problems, such as health and safety risks extending from materials used and inadequate containment of fine toner dust, for example. Likewise, using a CRU beyond its useful life may have a detrimental effect on print quality and/or on machine components. In some instances, it is desirable to determine whether a machine, especially the CRU, is being operated in accordance to contractual obligations such as warranty or licenses.

One early technique to authenticate CRUs relied on keyed shapes of the consumable. Such keyed shapes can be designed so that only a consumable in the keyed shape will fit into a given type of host. As an example, an ink jet printer can be adapted to receive only refill ink cartridges having a particular keyed shape. The use of such a keyed shape can prevent interchange of consumables between different types of host. That approach is generally ineffective for authentication, however, because the keyed shape of the consumable can be readily observed and easily duplicated.

For the reasons stated above, and for other reasons stated below which will become apparent to those skilled in the art upon reading and understanding the present specification, there is a need in the art for validating and authenticating a customer releasable unit.

SUMMARY

The disclosure relates to a computerized method and system for authenticating an imaging device consumer replaceable unit (CRU) used in products such as a printing system with appropriate programming such that they are able to positively recognize and accommodate authorized consumables. A microcontroller or processing chip is integrated with the CRU and capable of generating a Validation Code. A code key will be comprised of a value string including programmed characters representing a combination of a market program designator or code, consumable identification (ID) information and a randomly generated value that may be hidden from view. The resulting string key is a basis for an algorithm created Validation Code. This code is generated by the consumable processor and readable by a printing system or device the CRU is inserted into. The code is independently established by the printing system or device using the same algorithm and information and validates the resulting Code when they match. The printing system or device must confirm the Validation Code and ID applicability of the consumable to deem it appropriate for use.

DETAILED DESCRIPTION

Figure 1:
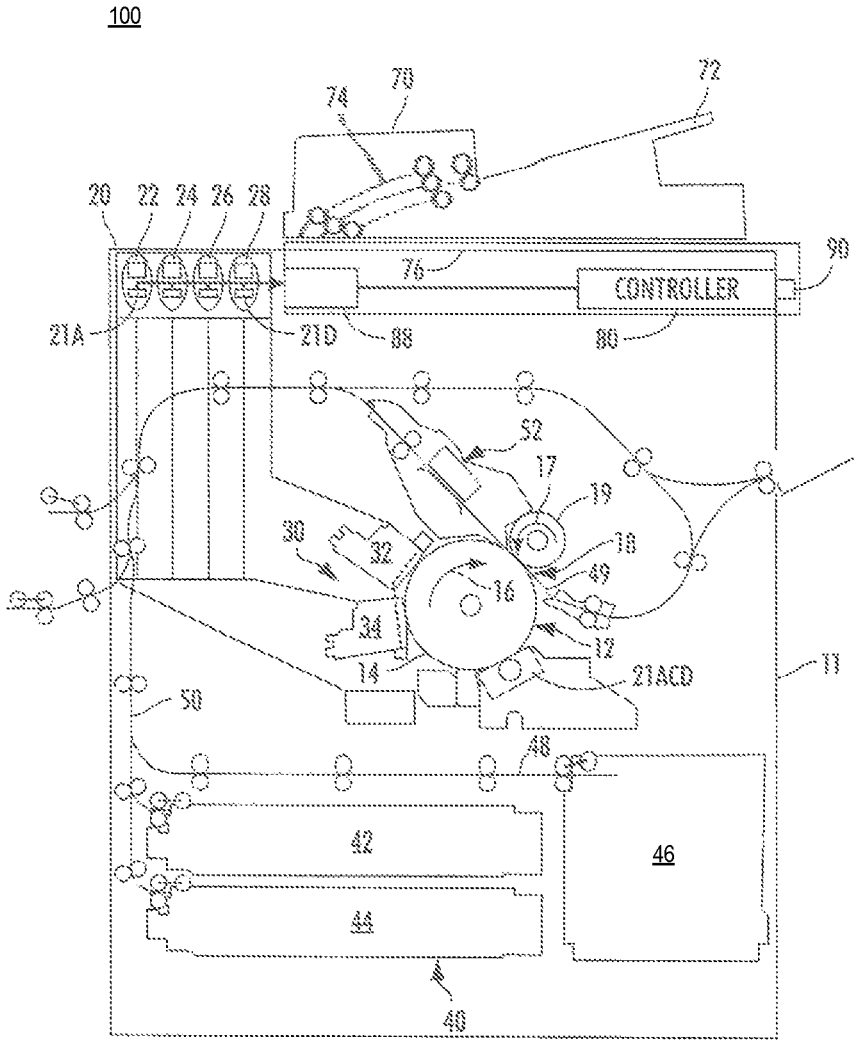
FIG. 1 is a simplified elevational view of a printing system such as a phase change ink image producing machine with controller capable of implementing an authentication service related to at least one replaceable unit in accordance to an embodiment.

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

In one aspect, the invention is directed to a computerized method and system for authenticating a consumable article in a product such as a printing system. A consumable article can comprise any one of a number of items, including but not limited to a toner cartridge, a marking or imaging unit, and other components well known to those in the art. The consumable article includes a processing chip that is capable of generating a validation code. The consumable has a code key that comprises a value string including programmed characters representing a combination of a market program designator or code, consumable identification information and a randomly generated value that may be hidden from view. The product reads the data in the consumable ship to derive an equivalent code key. The resulting string key is the basis for an algorithm created Validation Code that is generated by both the product and the consumable. In a first instance the validation code is generated at the consumable processor and readable by the device it is inserted into. In another instance the validation is recorded or stored in the consumable article and the validation code is generated at the product through an authentication function.

In another aspect, the disclosed embodiment is a method to authenticate a customer replaceable unit in a printer system by performing the steps of reading identification data and a key code element stored on the customer replaceable unit; reading a validation code stored on the customer replaceable unit; applying an authentication function to the identification data and key code element to calculate a printer generated validation code; determining that the customer replaceable unit is authentic only if the validation code corresponds to the printer generated validation code; and permitting use of the customer replaceable unit in the printer system when the customer replaceable unit is determined to be authentic.

In yet another aspect, the disclosed embodiment is a method wherein the identification data includes customer replaceable unit serial number, physical form characteristics, and user defined values.

In still another aspect, the disclosed embodiment is a method wherein the key code element is a string value that is based on the identification data and a random generated value.

In yet another aspect, the disclosed embodiment is a method wherein the authentication function is an encryption transformation of the identification data and key code element.

In another aspect, the disclosed embodiment is a method wherein the authentication function uses a SHA-1 (Secure Hash Algorithm) engine.

In another aspect, the disclosed embodiment is a method wherein authenticating the customer replaceable unit is comparing the validation code to the printer generated validation code.

Still in another aspect, the disclosed embodiment is a method that further comprises determining if the customer replaceable unit is compatible with the printing system based on the identification data.

In another aspect, the disclosed embodiment is a method wherein permitting use is authorizing use of the customer replaceable unit at the printer system based on the compatibility and the authentication of the customer replaceable unit.

In another aspect, the disclosed embodiment is a method that further comprises providing a counter on the customer replaceable unit, the counter configured to be read by the printer system; periodically updating a customer replaceable unit usage value in the counter as the customer replaceable unit is used to reflect an extent of usage or depletion of the customer replaceable unit; reading the customer replaceable unit usage value by the printer system; determining that the customer replaceable unit is authentic only if the customer replaceable unit usage value is less than a predetermined value; and permitting use of the customer replaceable unit in the printer system if the customer replaceable unit is authentic and disabling use of the customer replaceable unit in the printer system if the customer replaceable unit is not authentic.

In yet another aspect, the disclosed embodiment is a network arrangement to authenticate a replaceable unit of a printing system comprising a network connecting a plurality of locations in the printing system; a replaceable unit at each of the locations connected to the network, each of the replaceable units having a memory structure with identification data, a key code element, and validation code; and a controller connected to the replaceable unit at each of the locations through the network, wherein the controller executes instructions to handle authentication services for each of the locations by: reading the identification data and the key code element stored on the customer replaceable unit; reading the validation code stored on the customer replaceable unit; applying an authentication function to the identification data and key code element to calculate a printer generated validation code; determining that the customer replaceable unit is authentic only if the validation code corresponds to the printer generated validation code; and permitting use of the customer replaceable unit in the printer system when the customer replaceable unit is determined to be authentic.

Still in another aspect, the disclosed embodiment is a computer-accessible medium having executable instructions to authenticate a customer replaceable unit in a printer system, the executable instructions capable of directing a processor to perform: reading identification data and a key code element stored on the customer replaceable unit; reading a validation code stored on the customer replaceable unit; applying an authentication function to the identification data and key code element to calculate a printer generated validation code; determining that the customer replaceable unit is authentic only if the validation code corresponds to the printer generated validation code; and permitting use of the customer replaceable unit in the printer system when the customer replaceable unit is determined to be authentic.

Embodiments as disclosed herein may also include computer-readable media for carrying or having computer-executable instructions or data structures stored thereon for operating such devices as controllers, sensors, and electromechanical devices. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

The term "printing system" or "printer" as used herein refers to a digital copier or printer, image printing machine, digital production press, image reproduction machine, bookmaking machine, facsimile machine, multi-function machine, or the like and can include several marking engines, feed mechanisms, scanning assembly as well as other print media processing units, such as paper feeders, finishers, and the like.

As used herein, the term "controller area network" or "control area network" (CAN) is used to describe a control bus and associated control processor typically found in printer system.

FIG. 1 is a simplified elevational view of a printing system such as a phase change ink image producing machine 100 or solid ink (SI) printer with controller capable of implementing an authentication service related to at least one replaceable unit in accordance to an embodiment. As illustrated, the solid ink printer 100 includes a frame 11 to which are mounted directly or indirectly all its operating subsystems and components, as described below. To start, the solid ink printer 100 includes an imaging member 12 that is shown in the form of a drum, but can equally be in the form of a supported endless belt or other movable surface. The imaging member 12 is movable in the direction 16 has an imaging surface 14, which may be an intermediate transfer surface or coating, on which phase change ink images are formed. A heated transfix roller 19 rotatable in the direction 17 is loaded against the surface 14 of drum 12 to form a transfix nip 18, within which ink images formed on the surface 14 are transfixed onto media 49, such as paper which may be heated prior to entering the nip 18. In the phase change ink image producing machine 100, the printing process begins with a maintenance drum/roller 21ACD applying an ultra thin liquid layer, such as silicone oil, to facilitate ink release from the drum 12. Melted ink from the feed system flows into an ink reservoir in a printhead 32 and, in this example, a second printhead 34. Any number of printheads may be employed. The maintenance drum 21ACD includes a CRUM that comprises a non-volatile memory device (e.g., an electrically erasable programmable read-only-memory (EEPROM), flash memory, or the like) electrically connected to controller 80. The terms CRUM or chip are intended to mean essentially the same thing and may be used interchangeably herein.

The solid ink printer 100 includes a phase change ink loader 20 that is configured to receive phase change ink in solid form, referred to herein as ink or toner cartridge or solid ink sticks. The ink loader 20 also includes a phase change ink melting assembly (not shown) for melting or phase changing the solid form of the phase change ink into a liquid form. Phase change ink is typically solid at room temperature. The ink melting assembly is configured to heat the phase change ink to a melting temperature selected to phase change or melt the solid ink to its liquid or melted form. Currently, common phase change inks are typically heated to about 100.degree. C. to 140.degree. C. to melt the solid ink for delivery to the printhead(s). Thereafter, the phase change ink handling system is configured to communicate the molten phase change ink to a printhead system including one or more printheads, such as printhead 32 and 34. Any suitable number of printheads or printhead assemblies may be employed. The ink melting device may not be integrated into the ink loader.

As further shown, the phase change ink image producing machine or SI printer 100 includes a media or substrate supply and handling system 40. The substrate supply and handling system 40, for example, may include sheet or substrate supply sources 42, 44, 46, of which supply source 46, for example, is a high capacity paper supply or feeder for storing and supplying image receiving substrates in the form of cut sheets 49 via path 48 and path 50, for example. The substrate supply and handling system 40 also includes a substrate or sheet heater or pre-heater assembly 52. The SI printer 100 as shown may also include an original document feeder 70 that has a document holding tray 72 tray 72, a document transport path 74 and a document exposure and scanning system 76.

Figure 2:
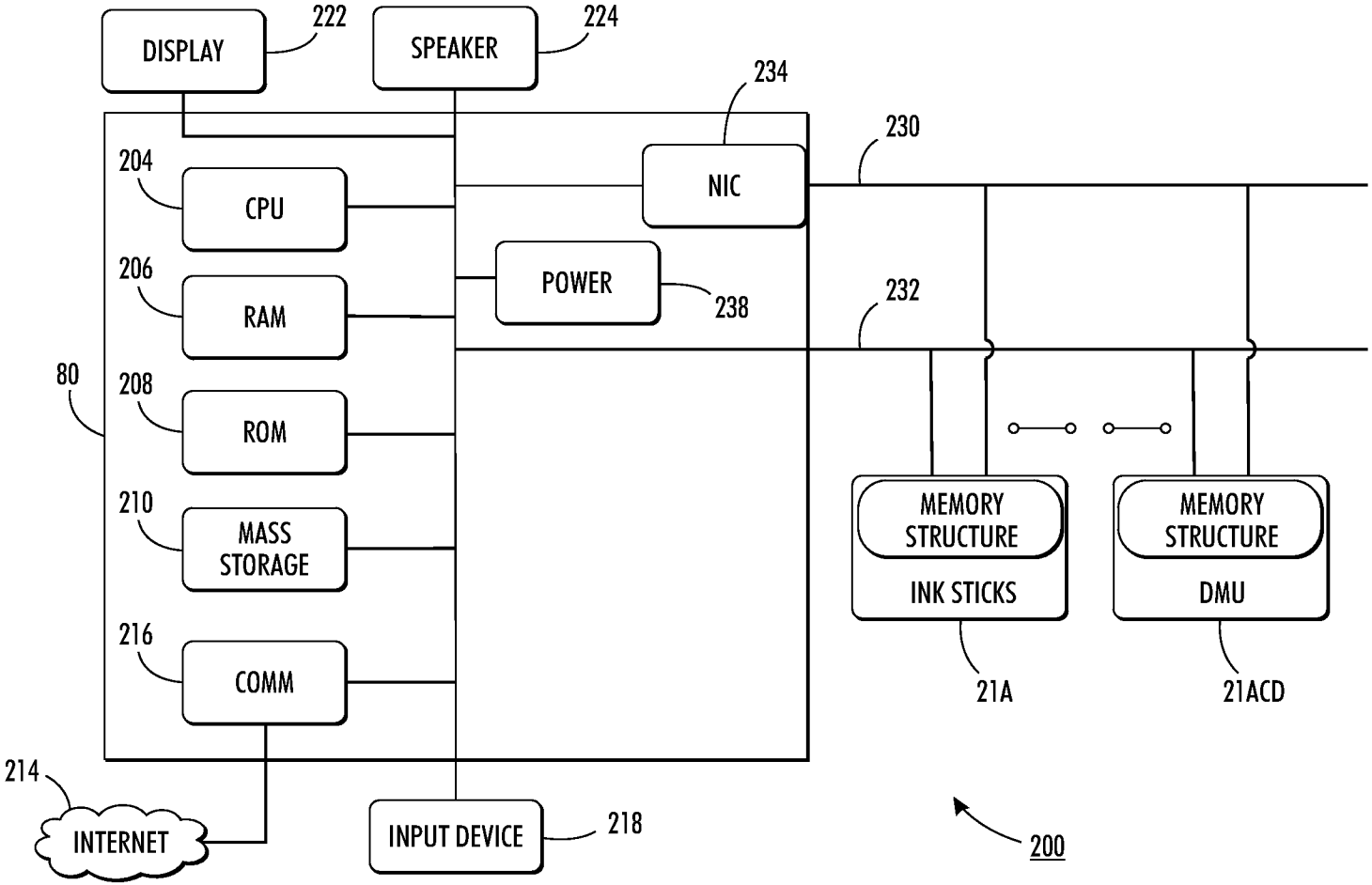
FIG. 2 is an exemplary block diagram of a controller and replaceable units having a memory structure in accordance to an embodiment.

Operation and control of the various subsystems, components and functions of the machine or SI printer 100 are performed with the aid of a controller or electronic subsystem (ESS) 80. The ESS or controller 80 for example, may be a self-contained, dedicated mini-computer having a central processor unit (CPU) 204, electronic storage (206,208,210), and a display or user interface (UI). The ESS or controller 80 for example includes sensor input and control 88 as well as a pixel placement and control as shown in FIG. 2. In addition the CPU 204 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling the machine subsystems and functions. Multiple controllers or processing units may be used, each accomplishing specific operation functions that may differ from other processing units. Convenient reference to a controller or a processor is intended to encompass non-described configurations where multiple such units may be employed.

As illustrated, the solid ink printer 100 is a multicolor imaging solid ink printer includes a phase change ink handling system 20 configured for use with multiple different colors of solid ink, typically cyan 22, magenta 24, yellow 26, and black 28 (CMYK). The solid ink printer 100, however, may be configured to use more or fewer different colors or shades of ink. The melting assembly (not shown) includes a heated plate.

Ink sticks (22, 24, 26, and 28) of each color are delivered through a corresponding individual one of the feed channels. In an electro-photographic printer, the typical equivalent ink would be toner provided in cartridges. The ink handling system 20 has a unique key plate with openings to aid the printer user in ensuring that only ink of the proper color are inserted into each feed channel. Each keyed opening of the key plate has a different and unique shape. The ink sticks of the color for that feed channel have a shape corresponding to the shape of the respective keyed opening. The keyed openings and corresponding ink shapes exclude from each ink feed channel ink sticks of all colors except the ink of the proper color for that feed channel. In one alternate configuration, solid ink may be provided to the printer in cartridges filled with ink in a pelletized or powdered form (not shown). Each of the ink cartridges may include an electronically-readable identification device. In yet another alternate configuration, an ID device may be attached to the ink or may be on a portion of removable packaging or a pull off tab or strip. The device may be manually removed after the data is read electronically and the ink or cartridge is authorized. Another configuration enabling the authentication process is solid ink in a cartridge or container where a larger solid volume is melted in the cartridge and interfaces with a delivery system in the printer. Such a cartridge may be equipped with a CRUM or similar ID chip to accomplish the authentication and validation as earlier described. The "ID information" contained in a CRU chip or CRUM includes all information pertinent to the CRU including the values associated with security, validation and CRU usage. Reference specifically to the ID of the CRU excludes the security aspects of identification, such as random values and validation key or code.

Figure 5:
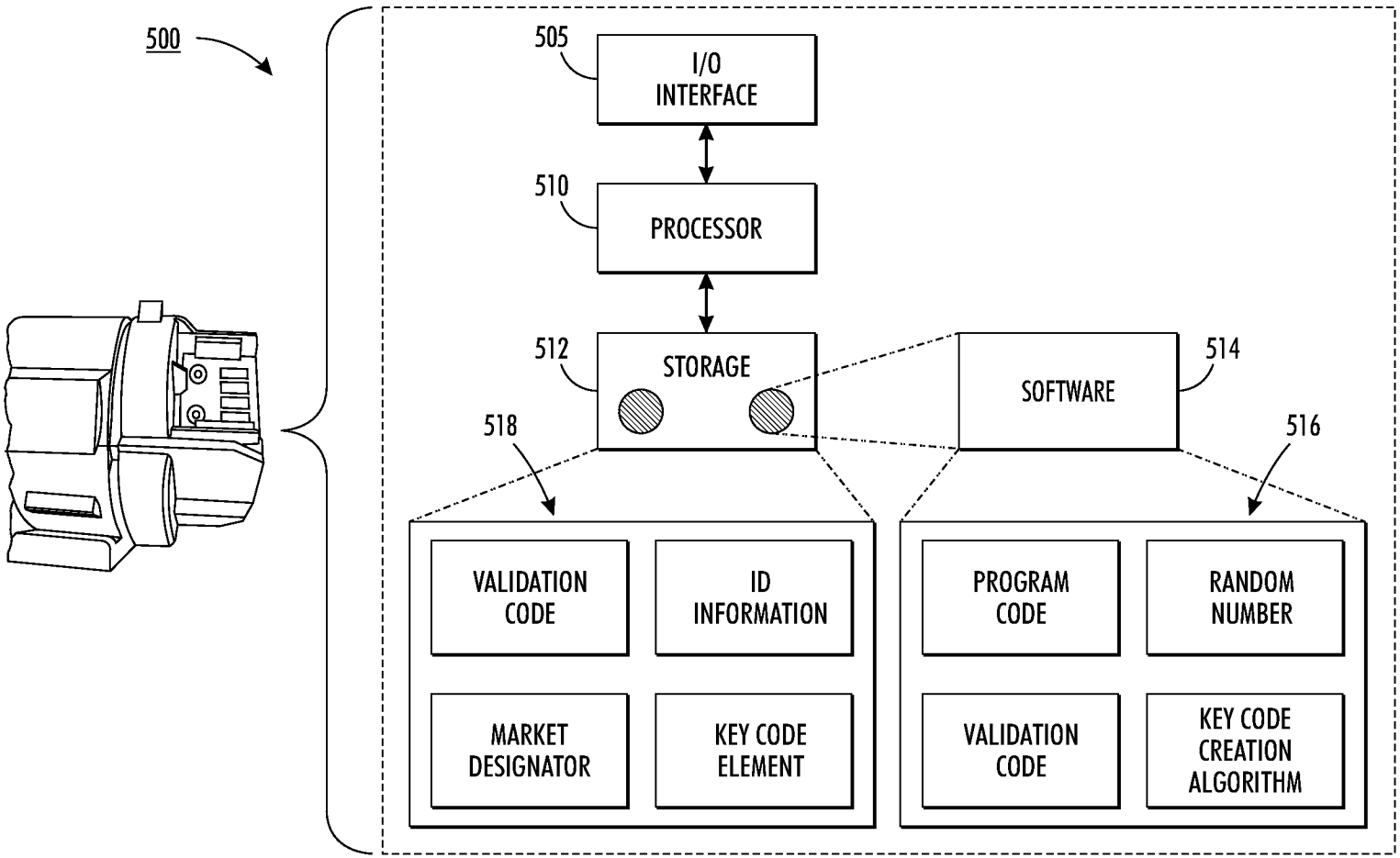
FIG. 5 is an illustration of the hardware and operating environment in a consumer replaceable unit in accordance to an embodiment.

Printers utilizing electro-photographic (EP) technology typically contain many customer replaceable units, several of which may incorporate a CRUM or similar ID chip, for example, toner cartridges and marking units. An example of a customer replaceable unit (CRU) monitoring system 200 in a network arrangement is shown in FIG. 2. An example of a monitoring system 500 in a consumable having at a minimum a controller and memory structure is shown in FIG. 5. Monitoring system 500 has hardware similar to that shown for controller 80 in FIG. 2. Regardless of the arrangement each CRUM may include multiple memories and circuitry of different types. To enable the CRUM to be electrically connected and disconnected with the printing system on installation or removal of the CRU, contact pads, pins or the like are provided. Each CRU contains a memory structure created in a nonvolatile memory (NVM) with assigned fields and with assigned levels of protection as discussed in FIG. 3 and FIG. 5. Each CRUM may contain read only memory, processors, circuitry, or logic devices for holding identification information and/or monitoring and executing instructions that permit it to fully perform authenticating functions like calculating a validation code that is stored and made available to other devices or subscribers such as printer system shown in FIG. 1, users of the printer system, or any other authorized user that has a connection either directly or through a network to the CRUM. The CRUs are communicatively connected to controller 80 or to each other by a communication path which may include cabling, optical coupling, or wireless means that use infrared, radio frequency (RF), ultrasound, optical technologies or the like. Communication path may also be a network, such as a standard wide area network (WAN) 232, or CAN-bus 230, and the like.

Various memory systems may be used in the CRUM including ROM, RAM, EEPROM, magnetic, or optical. Data relating to the CRU may be stored in a memory on the CRUM. For example, a preset number of total images for the CRU, various threshold(s) values of use for notice for the CRU, and various predetermined information to aid the user may be programmed into the CRUM by the manufacturer.

The CRUM may include addressable memory for storing information about the CRU such as installation date, identification information, and embedded executables for performing certain functions, or fields that are determined from monitored fields like key strings to facilitate the determination of a validation code. The CRUM can store data relating to label and electronic identification that is similar across a range of products and or sales programs, unique ID, fill amount, life estimation threshold, life data, remaining life identifier, physical form, such as keying features and/or package size and shape. Further, information included in the CRUM or electronic chip of a CRU will have the Product Code (product/market program and/or geographic intent/compatibility), a random value and identification (ID) information, which may include at the least any one or more of the following: processor or chip serial number (S/N), consumable serial number (S/N), manufacturer, part number, date of manufacture, batch designator, validation code, and any other code that differentiate product type, manufacturer, or the like. Random values (seeds) used for code creation and verification may be any number of digits and can comprise numbers, letters, spaces, symbols, such as ASCII characters, or any combination. Non number components for any value, string or code may be converted to numerical digits or values, or vise versa, at any desired step using any appropriate scheme. The validation code is created by mathematic manipulation of the key code, a value string that is comprised of selected values or characters from those used in the Product Code, Random Value and any other appropriate ID Information. The Validation Code is a one way process. There will be instances where the validation code will be determined by circuitry in the consumable (CRU) and where the consumable would only be a vessel that carries the validation code. The stored or recorded validation can be done by a process that is external to the CRU such as at the factory where the CRU was manufactured or at another location where the validation code is downloaded to the CRU via a network such as the internet during the initial authentication process or other appropriate time prior to or just after installation.

The description of FIG. 2 provides an overview of computer hardware and a suitable computing environment in conjunction with which some embodiments can be implemented. Embodiments are described in terms of a computer executing computer-executable instructions. However, some embodiments can be implemented entirely in computer hardware in which the computer-executable instructions are implemented in read-only memory. Some embodiments can also be implemented in client/server computing environments where remote devices that perform tasks are linked through a communications network. Program modules can be located in both local and remote memory storage devices in a distributed computing environment.

Controller 80 includes a processor 204, commercially available from Intel®, Motorola®, Cyrix® and others. Controller 80 also includes random-access memory (RAM) 206, read-only memory (ROM) 208, and one or more mass storage devices 210, and a system bus, that operatively couples various system components to the processing unit 204. The memory 206, 208, and mass storage devices, 210, are types of computer-accessible media. Mass storage devices 210 are more specifically types of nonvolatile computer-accessible media and can include one or more hard disk drives, floppy disk drives, optical disk drives, and tape cartridge drives. The processor 204 executes computer programs stored on the computer-accessible media.

A user enters commands and information into the controller 80 through input devices such as a keyboard 218 or a pointing device 220. The input device 218 such as a keyboard permits entry of textual information into computer 36, as known within the art, and embodiments are not limited to any particular type of keyboard. A Pointing device (not shown) permits the control of the screen pointer provided by a graphical user interface (GUI) of operating systems such as versions of Microsoft Windows®. Embodiments are not limited to any particular pointing device 220. Such pointing devices include mice, touch pads, trackballs, remote controls and point sticks. Other input devices (not shown) can include a microphone, joystick, game pad, satellite dish, scanner, or the like.

In some embodiments, controller 80 is operatively coupled to a display device 222. Display device 222 is connected to the system bus. Display device 222 permits the display of information, including computer, video and other information, for viewing by a user of the computer. Embodiments are not limited to any particular display device 222. Such display devices include cathode ray tube (CRT) displays (monitors), as well as flat panel displays such as liquid crystal displays (LCD's). In addition to a monitor, computers typically include other peripheral input/output devices such as printers (not shown). Speaker 224 provides audio output of signals. Speaker 224 is also connected to the system bus.

Controller 80 also includes an operating system (not shown) that is stored on the computer-accessible media RANI 206, ROM 208, and mass storage device 210, and is executed by the processor 204. Examples of operating systems include Microsoft Windows®, Apple MacOS®, Linux®, UNIX®. Examples are not limited to any particular operating system, however, and the construction and use of such operating systems are well known within the art.

Embodiments of controller 80 are not limited to any type of computer. In varying embodiments, controller 80 comprises a PC-compatible computer, a MacOS®-compatible computer, a Linux®-compatible computer, or a UNIX®-compatible computer. The construction and operation of such computers are well known within the art.

Controller 80 can be operated using at least one operating system to provide a graphical user interface (GUI) including a user-controllable pointer. Controller 80 can have at least one web browser application program executing within at least one operating system, to permit users of controller 80 to access an intranet, extranet or Internet world-wide-web pages as addressed by Universal Resource Locator (URL) addresses. Examples of browser application programs include Netscape Navigator® and Microsoft Internet Explorer®.

The controller 80 can operate in a networked environment using logical connections to one or more remote devices, such as CRUs 21A, 21D and 21ACD. These logical connections are achieved by a communication device coupled to, or a part of, the controller 80. The communication device may include cabling, optical coupling, or wireless means that use infrared, radio frequency (RF), ultrasound, optical technologies or the like. Embodiments are not limited to a particular type of communications device. The logical connections depicted in FIG. 2 include a local-area network (LAN) and a wide-area network (WAN) 232. Such networking environments are commonplace in offices, enterprise-wide computer networks, intranets, extranets and the Internet.

When used in a LAN-networking environment, the controller 80 and modules are connected to the local network through network interfaces or adapters 234, which is one type of communications device 216. A remote computer (not shown) may be provided that also includes a network device. When used in a conventional WAN-networking environment, the controller 80 and the remote computer communicate with a WAN 232 through modems (not shown). The modem, which can be internal or external, is connected to the system bus. In a networked environment, program modules depicted relative to the controller 80, or portions thereof, can be stored in the remote computer. Controller 80 also includes power supply 238. Each power supply can be a battery.

Figure 3:
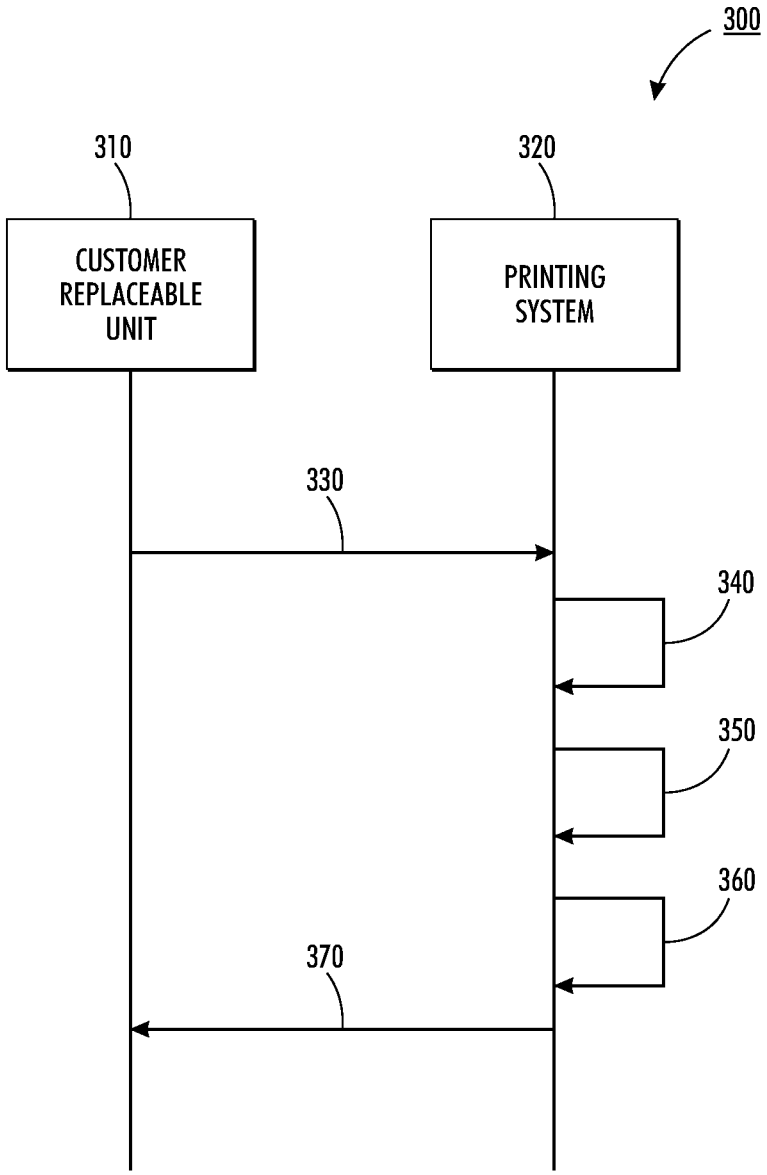
FIG. 3 is an illustration of a customer replaceable unit and printer system exchange sequence in accordance to an embodiment.

FIG. 3 is an illustration of a customer replaceable unit and printer system exchange sequence 300 in accordance to an embodiment. The exchange occurs along exchange paths 330,370. The exchange begins with a CRU 310 providing the printing system 320 with a validation code (VCCRUM) whether calculated at the CRU or stored at the CRU, and data value selected from the group consisting of ID information associated with the customer replaceable unit, which includes a randomly generated value, and a market designator code. Select elements or the full values from the ID information are used to establish a code key and an algorithm is then used on the key string to create a validation code. The printing system receives 340 the validation code, data value comprising ID and random value, and other information enumerated above. With the received data the printing system performs authentication function 350 such calculating a validation code. The function is preferably unique and preferably secret to the manufacture of the authenticable CRU. The preparatory function can preferably map selected values received from the CRU to a unique result, although such a one-to-one mapping is not a requirement. A cryptological hash algorithm as MD5 (message digest 5) or SHA-1 (secure hash algorithm) may be used as the function. Aspects of the elements establishing the code key or other variables and/or the validation code can be varied based on market program, geography, first install as opposed to subsequent installs, promotion units and so forth. In one implementation, all factory units furnished initially would have unique first use identification differentiated from all subsequent installs. Use of multiple codes and validation code creation methods may allow an imaging product line to be preprogrammed for a series of expected CRU ID with or without code changes over its life as a further protection against the deciphering of a particular implementation. The printer system may be programmed before it is sold with the same authentication function later used to make consumable articles for use in the host device. However, it is foreseeable that printers can be furnished or updated with the authentication function.

The printer system after it generates its independent validation code ($V_{System}$) or any other code that differentiate product type, manufacturer, or the like then proceeds to perform the process of authenticating the customer replaceable unit. The process of authenticating 360 can be comparing its internally calculated value of $V_{SYSTEM}$ with the value of $V_{CRUM}$ read from the CRU. If the values agree, then this is an authenticated CRU of type "XXX" that is useable on that printer system. If an improper authentication code is detected, then all validity flags and remaining media counters may be reset to zero and locked by a reset flags process well known to those in the art. In addition to disabling print services an error code indicating "data mismatch" or "communication failure" is generated that can be stored in the memory of the consumable or possibly displayed on an appropriate operator interface. Other codes such as "fully used" or "VOID" or similar description indicating a non usable condition are equally possible.

A used consumables database or list may be made available to a server or kept in storage at the printer system to confirm that a previously used up CRU, determined by the ID information on the associated chip, is not being inserted. After the consumable is validated, it is used in the printer system in a use consumable process to enable printing functions. When it is determined that the CRU has been completely expended by the use consumable process, an identifier of the consumable article like the serial number (S/N) will be stored in a used consumable data list indicating that the particular consumable article is completely used. The used consumable data list can include an identification of all consumable articles loaded into the printing system and the percentage of life remaining in each consumable article. The used consumable data list can store information regarding a large number of previously used consumables such as, for example, a list of all toner cartridges used in a printer. The code creation algorithm/method variation set may be used in a specific incrementally progressive fashion, released in consumables spaced apart by quantity or time frame, as example. Products may be programmed to exclude acceptance of consumables adhering to a code result representing a method limited to "N" number of days, weeks or months beyond an in-service date or from the last consumable swap. Legitimate consumables of an earlier type may still be used if a correct enabling or authorization code, provided by the supplier after validation, is manually input. In such a case, the S/N of the unit would be tracked and duplicates not allowed. Duplicate S/N's are proof of illegitimate units. The marketing designator or code, also termed program code, is tied to the serial number and may be encoded at appropriate distribution points under control by the manufacturer.

Figure 4:
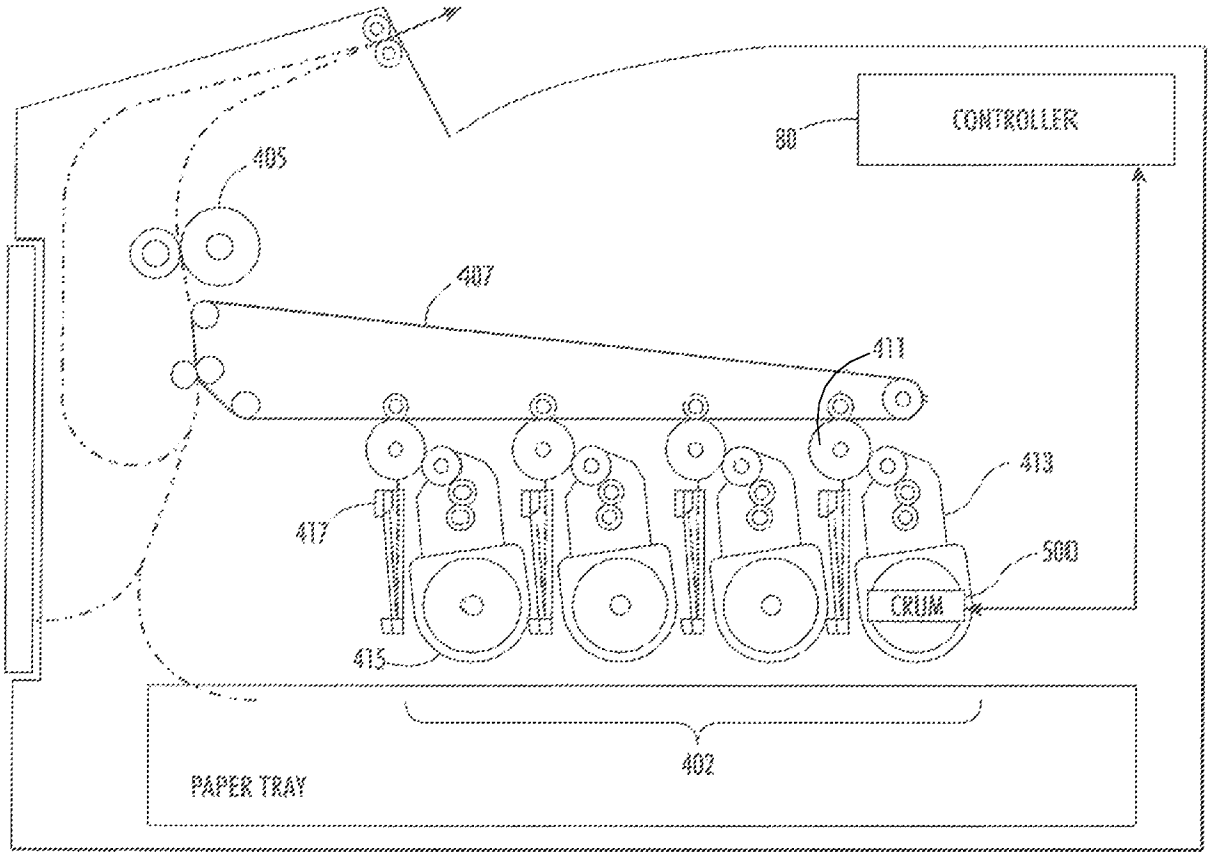
FIG. 4 is an illustration of an electro-photographic printer with control unit and the coupling therewith the CRUMs of the developer cartridge and the toner cartridge in accordance to an embodiment.

FIG. 4 is an illustration of an electro-photographic printer with control unit and the coupling therewith the CRUMs of the developer cartridge and the toner cartridge in accordance to an embodiment. The customer replaceable units illustrated are a plurality of toner cartridges 402 each may have individual consumable processors 500. The electro-photographic printer comprises a laser printer with laser or LED unit 417 employing a replaceable photoreceptor cartridge, a replaceable developer cartridge 413, and a replaceable toner cartridge 415 respectively, each of which is designed to provide a preset number of images in the form of prints or copies. And, while the printer is exemplified in the ensuing description and drawings as a printer, other types of reproducing machines such as copiers, ink jet printers, and the like may be envisioned.

Cartridges 402 typically are each warranted to produce a preset number of images (Y). When the number of remaining images reaches a predetermined level (X), a warning is given. This warning is to allow the customer time to order a new cartridge. After the warning has been given, the machine will continue to make the last remaining images (X). At this point, the total images (Y) have been made, the cartridge is disabled, and further operation of machine 10 is prevented. At that point, the "dead" cartridge must be removed and replaced by a new "live" cartridge for further operation of the printer.

The photoreceptor cartridge includes a photoreceptor drum 411, the outer surface of which is coated with a suitable photoconductive material, and a charge device for charging the drum photoconductive surface in preparation for imaging. The drum is suitable for rotation within the cartridge body, the drum 411 rotating in a direction to bring photoconductive surface or transfer belt 407 thereof past exposure, developer 413, and transfer stations of the printer on installation of the cartridge in the machine. To receive a photoreceptor cartridge, a suitable cavity is provided in the printer, the cartridge body and the cavity having complementary shapes and dimensions such that on insertion of the cartridge into the cavity, the drum 411 is in a predetermined operating relation with exposure, developer, and transfer stations respectively. With insertion of the cartridge, the drum 411 is drivingly coupled to a drum driving mechanism (not shown) and the electrical connections to the cartridge made. A fuser roller 405 fixes the transferred powder image to a copy sheet.

In order to assure that only authorized and unexpired xerographic, developer 413, and toner cartridges 415 are used as well as to maintain running count of the number of images made with each cartridge and prevent further use when the cartridge is used up, each cartridge has an identification/memory chip in the form of a customer replaceable unit memory (CRUM) 500 integral therewith.

The CRUM 500 may have numerous interactive functions, for example: allows the printer to send messages, either through the user interface or by programmed instruction, for the cartridge; monitor movement of subcomponents or pixels to ascertain the amount of toner available inside a cartridge or life of a component; provides a handshake feature with the controller 80 to ensure the correct cartridge is installed in the printer; shuts down the printer at the appropriate cartridge termination point; enables cartridge life cycle planning for remanufacture; enables remote diagnostics; and provides a safety interlock for the printer.

As note with reference to CRUMS 21A-21ACD, CRUM 500 can be an Electrically Erasable Programmable Read Only Memory (EEPROM). Alternately, the CRUM can be any type of electronic memory such as ROM, RAM, magnetic stripe, barcode or an optical memory system. Further it is possible that the CRUM may include multiple memory means of different types.

FIG. 5 is an illustration of the hardware 500 and operating environment in a consumer replaceable unit such as in toner cartridge 415 or drum maintenance unit 21ACD in accordance to an embodiment. The CRU has as minimum an input/output (I/O) interface 505 for exchanging data with the various controllers in the printing system or an authorizing authority having a processor for authenticating the CRU before it can operate in the printing environment. A processor for performing authenticating function after compiling software 514 in a storage device 512. It should be noted that the operating system of the processor 510 can be different than the OS of the controller or CPU 204. software component 514 may have objects 516 for performing the functions of generating a random number or randomly generated value, executable or program code for performing data gathering and manipulation, key code creation algorithm, and algorithm for generating a validation code. The random number may be generated at the factory and recorded on the CRUM. Memory unit 518 can include one or more cache, ROM, PROM, EPROM, EEPROM, flash, SRAM or other devices; however, the memory is not limited thereto. Memory unit can hold a unique identifier assigned to chip in CRU, a serial number assigned at the factory, a random number assigned at the factory, a media access control address, key code element string, a validation code determined in situ or assigned by an external source, a market designator code, additional identification or manufacturing information, any other code that differentiates product type, manufacturer, or the like. The content of storage 512, especially authentication program (software 514) and stored data 516, is hidden from potential piracy by being stored in the secure area. The authentication program cannot be read out from the processor nor can the program be observed during execution. This helps to prevent a potential pirate from determining or reconstructing the authentication algorithm which calculates the validation code. The same protection is afforded to the algorithm, data, and execution sequences at the printing system or authorization authority.

Figure 6:
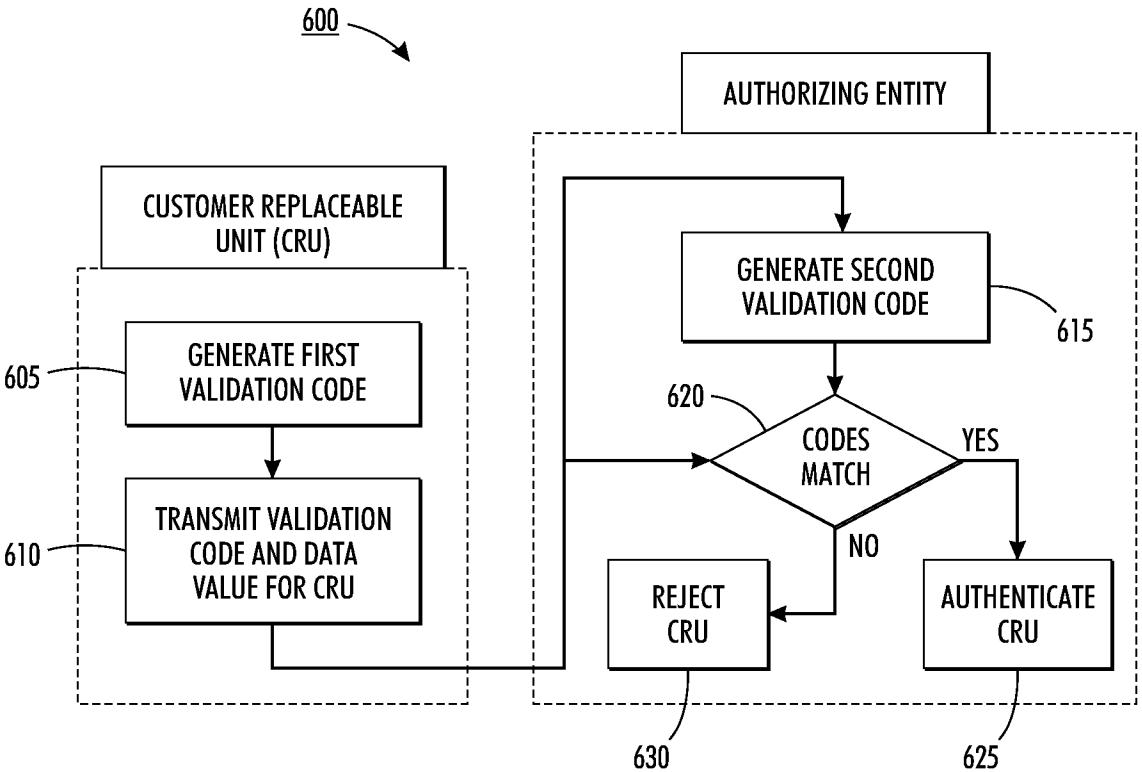
FIG. 6 is a flow chart of a method to authenticate a customer replaceable unit in a printer system in accordance to an embodiment.

FIG. 6 is a flow chart of a method 600 to authenticate a customer replaceable unit in a printer system in accordance to an embodiment. The use of a processing chip, rather than some form of ROM or other non processing chip in the consumable, allows the validation code to be determined within the consumable rather than being written to it. Since it is virtually impossible to recreate the validation code by means other than the proprietary and hidden method, any arbitrarily provided value would be wrong and result in the product not accepting the consumable. Having both the product and consumable establish a validation code based in part on a random number for comparison, all but eliminates any chance for imitation copies to be produced based on an original replacement consumable. The actions in method 600 are performed in the customer replaceable unit and the results from the CRU are then processed in the authorizing entity such as printing system shown in FIG. 1. In action 605 the CRU generates a first validation code using a programmed algorithm. In action 610 the generated validation code from action 605 is transmitted by action 610 along with data value for the CRU. The data value comprises data selected from the group consisting of ID information associated with the customer replaceable unit, a randomly generated value, and a market designator code. Select elements from these values and, as desired, ID information, are used to establish a code key string and an algorithm is then used on the key string to create a validation code. Control is then passed to action 615 in the authenticating authority. In action 615, the authorizing authority using the same algorithm and using the same key string as used in the CRU generates a second validation code. In action 620 determination is made between the first and second validation code. The determination in action 620 is comparison of the two strings to see if there is a match. If there is a match then the CRU is authenticated 625 and is allowed to function. If there is no match then the CRU is rejected 630 and prevented from operating. Preventing the CRU from operating may protect the printing system from non-compatible units that may introduce harmful or incompatible chemicals or materials and/or may prevent use of customer replaceable units intended to be available only within particular circumstances, for example contractual supplies programs or geographic region. Printing systems may be preprogrammed to create validation codes in multiple ways with the resulting value string used for a comparison match against the validation code created by the consumable processor. As long as one or any intended sequence, placement or number of validation codes generated by the printing system match the value or intended values in the CRU, it would be accepted. In this way, a periodic change in the method or algorithm used to create the validation code prevents or discourages production volumes from a source that deciphers an earlier used method, however unlikely that might be.

Figure 7:
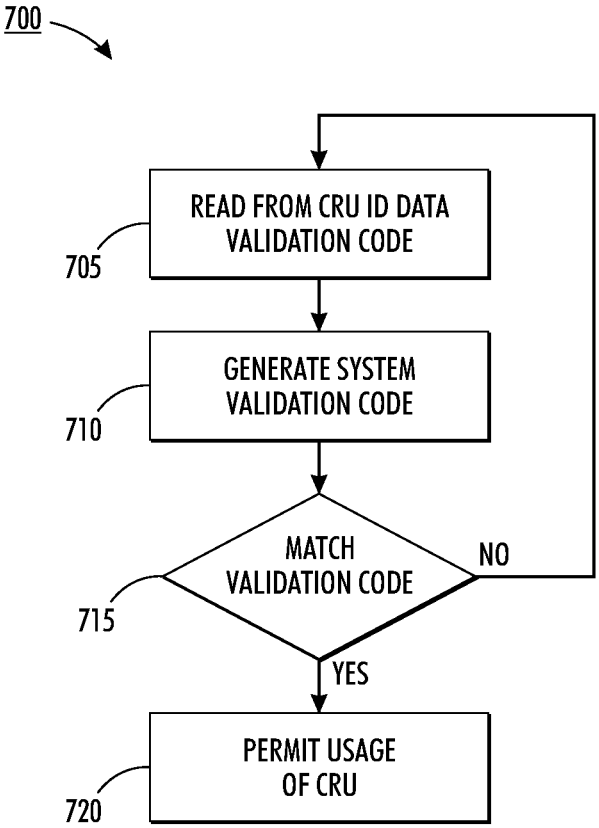
FIG. 7 is a flow chart of a method to generate a printer system validation code and CRU authentication in accordance to an embodiment.

FIG. 7 is a flow chart of a method 700 to generate a printer system validation code and CRU authentication in accordance to an embodiment. Method 700 covers the scenario where the validation code and the data are resident in the CRU. In action 705, the ID data and validation code is read from the CRU. In action 710, a system validation code is generated. A system validation code is a key produced by the system such as the printer using well known algorithms. In action 715, a comparison is done between the validation code read from the CRU and the system validation code generated by the printer. In action 720, if a match is found to exist the CRU is permitted to operate. If a match is not found, control is returned to action 705 where either a new CRU is introduced into the system or a new code is introduced into the CRU and the authentication process is repeated.

Figure 8:
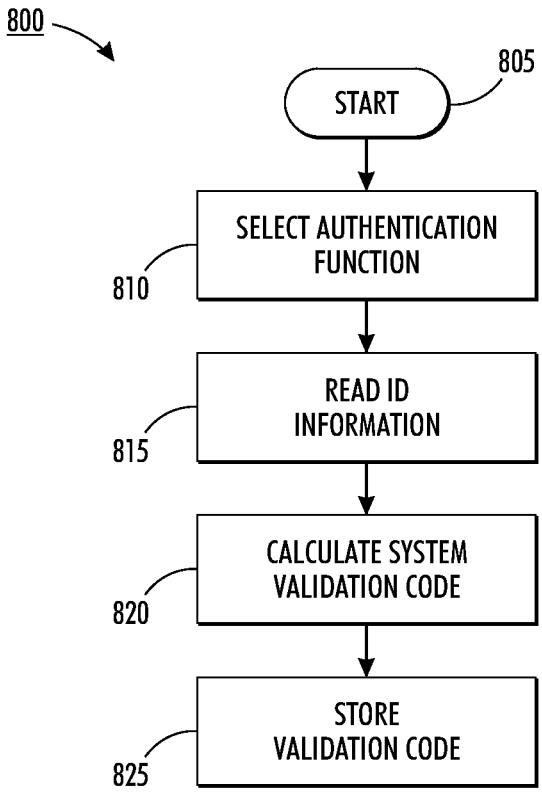
FIG. 8 is a flow chart of a method for generating and storing a validation code at the consumer replaceable unit in accordance to an embodiment.

FIG. 8 is a flow chart of a method 800 for generating and storing a validation code at the consumer replaceable unit in accordance to an embodiment. In method 800 the authorization authority selects the authentication function based on the CRU. In action 805 the action is commenced when the CRU is first inserted into the printing system. In action 810, a processor selects an authentication function for the customer replaceable unit. The selection can be based on the geographic location of the printing system, CRU generational differences, variations due to market program, geography, first install vs. subsequent installs, promotion units and so forth. As example, one type may use a 5 digit code and another type a 6 digit code. These differences can be accommodated by embedding the printing system with different algorithms that can be selected in the appropriate situation. After, the authentication function is selected in action 810 control passes to action 815 for further processing. In action 815, the ID information is read by the processor so it can be analyzed by the selected authentication function. In action 820, a system validation code is calculated from the read ID information. In action 825, the validation code is stored in volatile memory so it can be compared against the CRU validation code.

Figure 9:
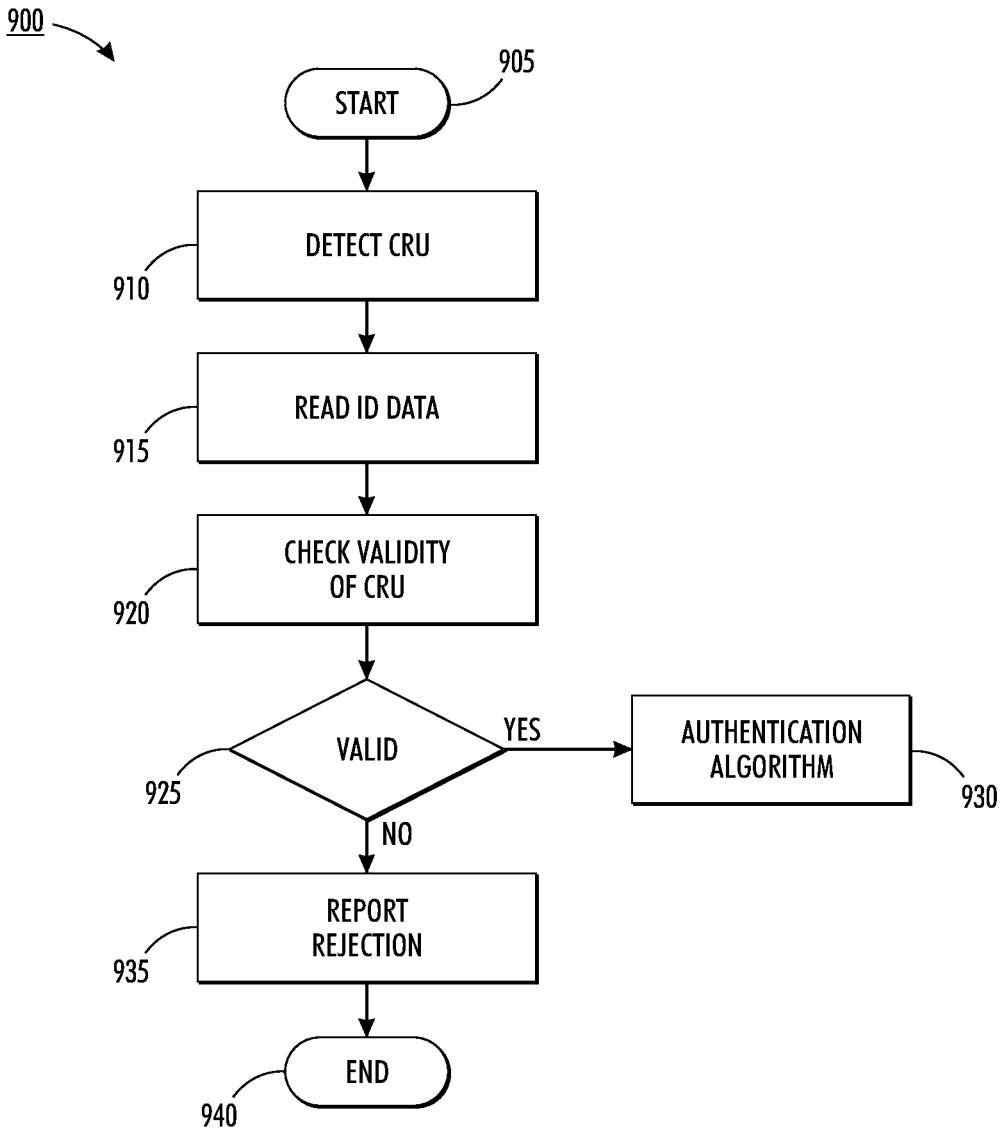
FIG. 9 is a flow chart of a method for validating a consumer replaceable unit in accordance to an embodiment.

FIG. 9 is a flow chart of a method 900 for validating a consumer replaceable unit in accordance to an embodiment. Method 900 and 1000 generally depicts the flow of operations and data flow of a system for one specific embodiment for checking the authenticity of a CRU loaded in a printing system. When a CRU is initially installed, the printing system first senses the newly loaded CRU through a detect CRU process 910. The CRU can be detected by a mechanical sensor by recognizing the proximity of a radio frequency transponder, or by any other suitable sensor for such detection. After detection of the new CRU, the printer reads 915 from a memory on the installed CRU the values of the serial number S/N, validation code, CRU type, and the like.

The reading of the data can be done as successive processes, a read serial number S/N process, a read CRU type process, and a read validation code process. The order of these operations is not important and can be performed in a different sequence in other embodiments without departing from the scope of the invention. After reading the CRU type, the validity of the CRU for the particular printing system is tested in a check consumable type validity process 920. CRU type may include physical form, such as keying features and/or package size and shape. Physical form differences are generally reserved for different product lines. Valid types of CRU for the particular printing system are known. If the CRU is of a type invalid 925 for the particular printing system, the host will report the status of an incompatible CRU using a report status process or report rejection 935 and terminate 940. If the media type is incompatible with the particular host, it is unnecessary to check authenticity of the media. If the CRU is type that is valid for the printing system then an authentication process 930 is initiated. Note that CRU serial number or other identifying information may be captured even if it is rejected so that is can be included in one or more CRU field activity/usage database.

Figure 10:
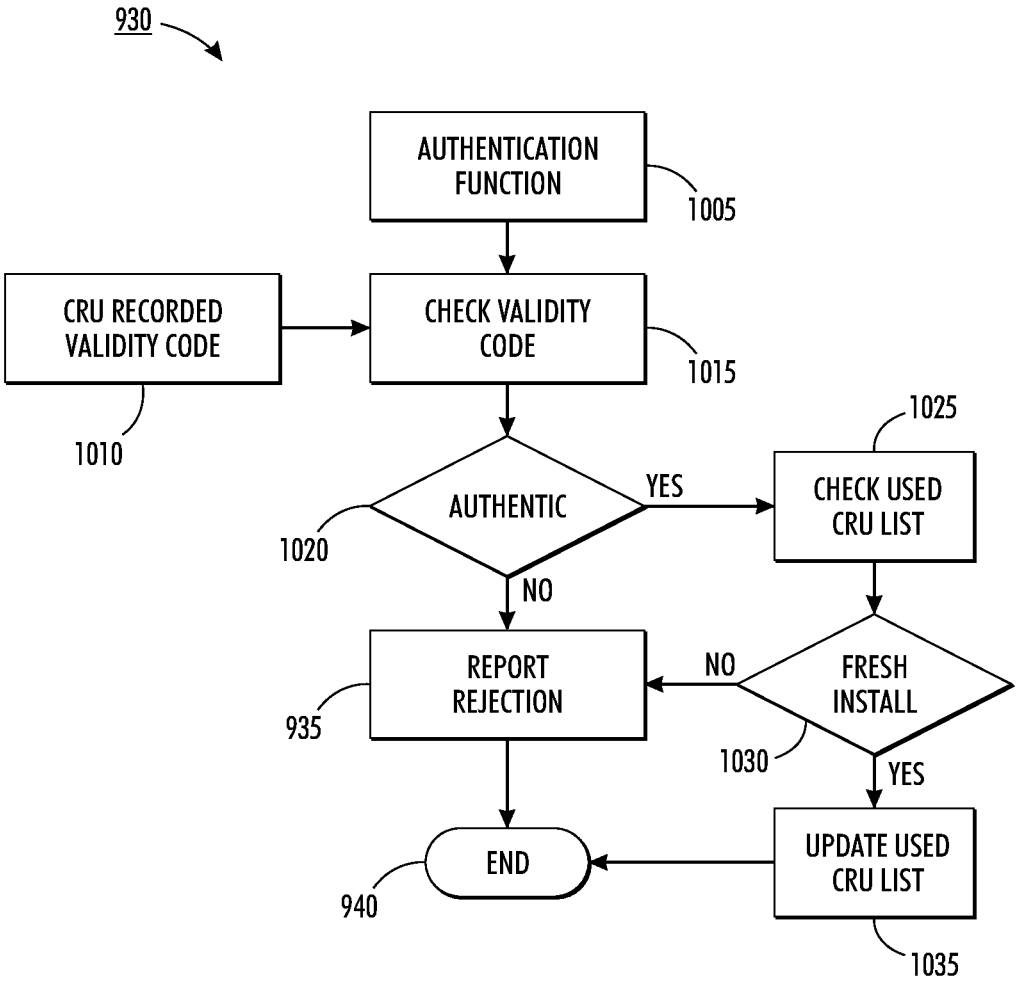
FIG. 10 is a flow chart of a method to authenticate and validate a CRU in a printing system in accordance to an embodiment.

FIG. 10 is a flow chart of a method to authenticate and validate a CRU in a printing system in accordance to an embodiment. Authentication function data 1005 is available for use in checking the authenticity of the CRU. The printing system may be programmed before it is sold with the same authentication function later used to make a CRU for use in the printing system. The sequence of actions defining the authentication function can be stored in the printing system as authentication function data. If the CRU is of a valid type for the particular printing system, the CRU validity code 1010 is checked using the authentication function 1005 in a check validity code process 1015. The check authentication process 1015 executes the algorithm defining the authenticating relationship using the different validity codes as input and compares its internally calculated value with the value read from the CRU. If they agree 1020, then this is an authenticated CRU of type "XXX" that is useable on that printing system. If a CRU is detected 1020 with an improper authentication code, then all validity flags and counters may be reset to zero and locked by a reset flags process. This counterfeit CRU is detected by the printer and may be made unusable for any future application once detected by setting its status, such as "fully used." A report status process or report rejection 935 and terminate 940 the authentication method 1000. A used CRU data list is made available to the printing system to confirm 1025 that a previously used 1030 up cartridge is not being inserted. After the CRU is validated, it is used in the host in a use consumable process (460). When it is determined that the CRU has been completely expended, an identifier of the CRU such as the unique serial number will be stored in a used consumable data list 1035 indicating that the particular consumable article is completely used. The used consumable data list can include an identification of all consumable articles loaded into the printing system and the percentage of life remaining in each consumable article.

Although specific embodiments of the present technology have been described, it will be understood by those of skill in the art that there are other embodiments that are equivalent to the described embodiments. Accordingly, it is to be understood that the technology is not to be limited by the specific illustrated embodiments, but only by the scope of the appended claims.

What is claimed is:

1. An authentication method to authenticate a customer replaceable unit in a printer system, the method comprising:

reading identification data and a key code element stored on the customer replaceable unit, the key code element being a string value that is based on the identification data and a random generated value;

reading a validation code stored on the customer replaceable unit;

applying an authentication function to the identification data and the key code element to calculate a printer generated validation code, the authentication function being an encryption transformation of at least portions of the identification data and the key code element;

determining that the customer replaceable unit is authentic only if the validation code corresponds to the printer generated validation code; and permitting use of the customer replaceable unit in the printer system when the customer replaceable unit is determined to be authentic.

2. The method according to claim 1, wherein the identification data includes one or more values from a group comprising at least a customer replaceable unit serial number, chip serial number, unique ID, fill amount, life estimation threshold, life data, remaining life identifier, product code and part number.

3. The method of claim 1, wherein the authentication function uses a SHA-1 (Secure Hash Algorithm) engine.

4. The method of claim 1, wherein authenticating the customer replaceable unit is comparing the validation code to the printer generated validation code.

5. The method of claim 4, further comprising:

determining if the customer replaceable unit is compatible with the printing system based on the identification data.

6. The method of claim 5, wherein the permitting the use of the customer replaceable unit is authorizing use of the customer replaceable unit at the printer system based on the compatibility and the authentication of the customer replaceable unit.

7. The method according to claim 1 further comprising:

providing a counter on the customer replaceable unit, the counter being configured to be read by the printer system;

periodically updating a customer replaceable unit usage value in the counter as the customer replaceable unit is used to reflect an extent of usage or depletion of the customer replaceable unit;

reading the customer replaceable unit usage value by the printer system; and determining that the customer replaceable unit is authentic only if the customer replaceable unit usage value is less than a predetermined value, the permitting the use of the customer replaceable unit in the printer system further comprising disabling use of the customer replaceable unit in the printer system if the customer replaceable unit is determined not to be authentic.

8. A network arrangement to authenticate a replaceable unit of a printing system comprising:

a network connecting a plurality of locations in the printing system;

a replaceable unit at each of the locations connected to the network, each of the replaceable units having a memory structure with identification data, a key code element, and validation code; and a controller connected to the replaceable unit at each of the locations through the network, the controller executing instructions to handle authentication services for each of the locations by:

reading the identification data and the key code element stored on the customer replaceable unit, the key code element being a string value that is based on the identification data and a random generated value;

reading the validation code stored on the customer replaceable unit;

applying an authentication function to the identification data and key code element to calculate a printer generated validation code, the authentication function being an encryption transformation of at least portions of the identification data and key code element;

determining that the customer replaceable unit is authentic only if the validation code corresponds to the printer generated validation code; and permitting use of the customer replaceable unit in the printer system when the customer replaceable unit is determined to be authentic.

9. The network arrangement according to claim 8, wherein the identification data includes one or more values from a group comprising at least a customer replaceable unit serial number, unique ID, fill amount, life estimation threshold, life data, remaining life identifier, chip serial number, product code and part number.

10. The network arrangement of claim 8, wherein the authentication function uses a SHA-1 (Secure Hash Algorithm) engine.

11. The network arrangement of claim 8, wherein authenticating the customer replaceable unit is comparing the validation code to the printer generated validation code.

12. The network arrangement of claim 11, further comprising:

determining if the customer replaceable unit is compatible with the printing system based on the identification data.

13. The network arrangement of claim 12, wherein the permitting the use of the customer replaceable unit is authorizing use of the customer replaceable unit at the printer system based on the compatibility and the authentication of the customer replaceable unit.

14. The network arrangement according to claim 8 further comprising:

providing a counter on the customer replaceable unit, the counter being configured to be read by the printer system;

periodically updating a customer replaceable unit usage value in the counter as the customer replaceable unit is used to reflect an extent of usage or depletion of the customer replaceable unit;

reading the customer replaceable unit usage value by the printer system; and determining that the customer replaceable unit is authentic only if the customer replaceable unit usage value is less than a predetermined value;

the permitting the use of the customer replaceable unit further comprising disabling use of the customer replaceable unit in the printer system if the customer replaceable unit is determined not to be authentic.

15. A non-transitory computer-accessible medium having recorded thereon executable instructions that, when executed by a processor, cause the processor to execute a method to authenticate a customer replaceable unit in a printer system, the method comprising:

reading identification data and a key code element stored on the customer replaceable unit, the key code element being a string value that is based on the identification data and a random generated value;

reading a validation code stored on the customer replaceable unit;

applying an authentication function to the identification data and key code element to calculate a printer generated validation code, the authentication function being an encryption transformation of at least portions of the identification data and key code element;

determining that the customer replaceable unit is authentic only if the validation code corresponds to the printer generated validation code; and permitting use of the customer replaceable unit in the printer system when the customer replaceable unit is determined to be authentic.

16. The non-transitory computer-accessible medium according to claim 15, wherein the identification data includes one or more values from a group comprising at least a customer replaceable unit serial number, unique ID, fill amount, life estimation threshold, life data, remaining life identifier, chip serial number, product code and part number.

17. The non-transitory computer-accessible medium of claim 15, wherein the authentication function uses a SHA-1 (Secure Hash Algorithm) engine.

18. The non-transitory computer-accessible medium of claim claim 15, wherein authenticating the customer replaceable unit is comparing the validation code to the printer generated validation code.

19. The non-transitory computer-accessible medium of claim 18, the method further comprising:

determining if the customer replaceable unit is compatible with the printing system based on the identification data.

20. The non-transitory computer-accessible medium of claim 19, wherein the permitting the use of the customer replaceable unit is authorizing use of the customer replaceable unit at the printer system based on the compatibility and the authentication of the customer replaceable unit.

21. The non-transitory computer-accessible medium according to claim 15, the method further comprising:

reading a customer replaceable unit usage value by the printer system; and determining that the customer replaceable unit is authentic only if the customer replaceable unit usage value is less than a predetermined value;

the permitting the use of the customer replaceable unit in the printer system further comprising disabling use of the customer replaceable unit in the printer system if the customer replaceable unit is not authentic, the customer replaceable maintaining a counter configured to be read by the printer system, and the customer replaceable unit periodically updating the usage value in the counter as the customer replaceable unit is used to reflect an extent of usage or depletion of the customer replaceable unit.

* * * * *